US011712081B1

(12) United States Patent
Thomas, Jr.

(10) Patent No.: US 11,712,081 B1
(45) Date of Patent: Aug. 1, 2023

(54) HEAD COVERING

(71) Applicant: David L. Thomas, Jr., Tampa, FL (US)

(72) Inventor: David L. Thomas, Jr., Tampa, FL (US)

( * ) Notice: Subject to any disclaimer, the term of this patent is extended or adjusted under 35 U.S.C. 154(b) by 122 days.

(21) Appl. No.: 17/327,935

(22) Filed: May 24, 2021

Related U.S. Application Data

(60) Provisional application No. 63/101,970, filed on May 26, 2020.

(51) Int. Cl.
*A42B 1/045* (2021.01)

(52) U.S. Cl.
CPC ..... *A42B 1/045* (2013.01)

(58) Field of Classification Search
CPC ..... A42B 1/045; A42B 1/012; A42B 1/018; A42B 1/0187; A42B 1/0188; A42B 1/205; A42B 1/049; A45D 8/40
See application file for complete search history.

(56) References Cited

U.S. PATENT DOCUMENTS 1,610,480 A * 12/1926 Seilaz ..... A45D 8/40 132/274
2,083,616 A * 6/1937 Rosenberg ..... A42B 1/045 2/203
2,109,248 A * 2/1938 Hibshman ..... A42B 1/045 66/171
2,125,739 A * 8/1938 Rosenberg ..... A42B 1/045 2/195.8
2,730,722 A * 1/1956 Colangelo ..... A41G 5/0093 2/202
2,881,449 A * 4/1959 Leatherwood ..... A42B 1/045 2/200.1
3,376,581 A * 4/1968 Gettinger ..... A42B 1/16 2/209.11
3,555,565 A * 1/1971 Zimmon et al. ..... A42B 1/012 2/195.7
3,710,396 A * 1/1973 Tomlinson ..... A42B 1/012 206/390
4,587,674 A * 5/1986 Berlin ..... B29C 66/1122 428/192
4,850,049 A * 7/1989 Landis ..... A42B 1/012 2/9
5,129,103 A * 7/1992 Gruneisen ..... A42B 1/208 2/206
5,218,723 A * 6/1993 McLaughlin ..... B29C 66/4312 2/125
5,694,648 A * 12/1997 Nucifora ..... A42B 1/0186 2/172
5,862,523 A * 1/1999 Proctor ..... A42B 1/247 2/209.11
5,875,493 A * 3/1999 MacDonald ..... A42B 1/205 2/171.1

(Continued)

*Primary Examiner* — Heather Mangine
(74) *Attorney, Agent, or Firm* — Frijouf, Rust & Pyle, P.A.

(57) ABSTRACT

A head covering is disclosed for shielding the hair and head of an individual comprises a hood defining a front edge, a first side edge, a second side edge and a rear edge for engaging over the hair and the head of the individual. A rear panel is coupled to the rear edge of the hood. A pouch is defined within the rear panel for receiving the hair of the individual. A first tether is coupled to the first side edge of the hood. A second tether is coupled to the second side edge of the hood.

10 Claims, 10 Drawing Sheets

(56) References Cited

U.S. PATENT DOCUMENTS 5,887,287 A * 3/1999 Potochnik ..... A42B 1/241 2/172
5,933,870 A * 8/1999 Egan, Jr. ..... A42B 1/24 2/181.6
5,978,967 A * 11/1999 Williams ..... A42C 5/04 2/202
6,425,138 B1 * 7/2002 Johnson ..... A42B 1/045 2/202
6,665,876 B1 * 12/2003 Newman ..... A41D 13/08 2/207
6,738,986 B1 * 5/2004 Martin ..... A42B 1/041 2/207
6,857,134 B1 * 2/2005 Cowell ..... A42C 5/04 2/209.13
7,096,510 B2 8/2006 Yeadon
7,310,829 B1 * 12/2007 Engel-Wilson ..... A42B 1/0187 2/209.13
7,412,729 B1 * 8/2008 McGovern ..... A42B 1/041 2/202
8,032,950 B2 * 10/2011 Leftenant ..... A42B 1/041 2/202
D669,662 S 10/2012 Reid
9,138,025 B1 * 9/2015 Lunsford ..... A42B 1/041
9,907,381 B2 3/2018 Tussey
2003/0221243 A1 * 12/2003 Phillips ..... A42B 1/049 2/202
2004/0079760 A1 * 4/2004 Rink, Jr. ..... A42B 1/045 221/26
2004/0154081 A1 * 8/2004 Zimmerman ..... A42B 1/22 2/423
2004/0244095 A1 * 12/2004 Sonne ..... A42B 1/0187 2/175.4
2005/0034215 A1 * 2/2005 Harrison ..... A42C 5/04 2/207
2006/0174398 A1 * 8/2006 Proctor ..... A42B 1/22 2/209.13
2006/0272073 A1 * 12/2006 Marquardt ..... A42B 1/012 2/171
2009/0089916 A1 4/2009 Leftenant
2009/0126078 A1 * 5/2009 Rashid ..... A42B 1/045 2/207
2009/0151048 A1 * 6/2009 Laury ..... A45D 44/00 132/273
2010/0294301 A1 * 11/2010 Blasingame ..... A45D 8/40 132/274
2011/0107500 A1 * 5/2011 Wathen ..... A42B 1/0187 2/209.13
2012/0023642 A1 2/2012 Holland
2012/0079643 A1 * 4/2012 Clarke ..... A42B 1/041 2/171
2012/0317699 A1 * 12/2012 Barr ..... A42B 1/201 2/209.13
2014/0150164 A1 * 6/2014 Lucier ..... A42B 1/208 2/173
2015/0209621 A1 * 7/2015 Cason ..... A42B 1/12 2/68
2016/0198830 A1 * 7/2016 Tussey ..... A42B 1/049 2/183
2016/0374419 A1 * 12/2016 Hunley ..... A42B 1/008 2/171.2
2017/0066583 A1 * 3/2017 Kimbrough ..... A41D 13/0056
2019/0037944 A1 * 2/2019 Tussey ..... A42B 1/049
2019/0045864 A1 * 2/2019 Teat ..... A42B 1/0187
2019/0090556 A1 * 3/2019 Ayres ..... A42B 1/241
2020/0297057 A1 * 9/2020 Davis ..... A42B 1/0184
2021/0045488 A1 * 2/2021 Vargas ..... A42B 1/22
2021/0106113 A1 * 4/2021 Lee ..... A42B 1/012
2022/0022583 A1 * 1/2022 Royal ..... A42B 1/045

* cited by examiner

HEAD COVERING

CROSS-REFERENCE TO RELATED APPLICATIONS

This application claims benefit of U.S. Patent Provisional Application No. 63/101,970 filed May 26, 2020. All subject matter set forth in Provisional Application No. 63/101,970 is hereby incorporated by reference into the present application as if fully set forth herein.

BACKGROUND OF THE INVENTION

Field of the Invention

This invention relates to coverings and more particularly to a head covering for shielding an individual's head

Background of the Invention

Hair coverings can be utilized for many benefits. For example, hair coverings may be utilized to protect the hair and head of an individual. Exposing the hair and head of an individual to external elements such as rain, sleet, snow and the sun may result in disfiguring and damaging the individual's hair and head. Individuals may a visit hair salon wherein they expend substantial funds for cutting, conditioning and treating their hair. Furthermore, individuals that are exposed to ultraviolet radiation for long periods of time may result in skin cancer resulting in their detrimental health. Hair coverings may be utilized for preserving an individual's hair and head thereby improving their appearance and overall health.

There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 2,730,722 to Colangelo discloses a covering for the head comprising a fabric material having a semicircular portion and an extension defined by a pair of parallel edges tangent to the ends of the outer edge of the semicircular portion and a third edge parallel to and offset from the diameter of the semi circular portion. A hair fringe is sewn to the extension adjacent the third edge and extends beyond the central portion of the third edge. An elastic gathering cord is secured to the curved edge of the semicircular portion and a second elastic gathering cord is secured to the semi circular portion spaced inwardly from and lying parallel to the first named elastic gathering cord.

U.S. Pat. No. 5,978,967 to Williams discloses a cap useful for protecting against either rainwater or shower water is at least partially of transparent material that can hang down over the from of the face, the cap body portion including air vents over which flaps to keep out water are disposed. The cap further includes an integral hair pouch into which long hair, such as a pony tail, may be placed to protect that hair likewise from water. The pouch with contained hair can be allowed to hang down the back, or alternatively a hair pouch in the form of an arc within the cap interior may be used to contain the long hair or pony tail within an arc surrounding the upper neck, and leaving the lower neck and shoulders uncovered. Either of such embodiments is easily pressed into a flattened form and placed into an envelope of appropriate size so as to permit convenient storage using a minimum of shelf space.

U.S. Pat. No. 6,738,986 to Martin discloses a head covering that is particularly suited for use when participating in aquatic sports activities, such as scuba diving, snorkeling, sailing, and jet skiing, where the fabric is selected for its quick drying ability and stretchability, therein enabling excellent conformability to the body. Well known fabric brand names include Spandex, LYCRA®, and nylon or blends thereof. The head covering helps retain body heat, protect against sunburn, keep hair pulled away from a diver's mask, restrains hair in the back of the head, and makes divers on the surface more visible to boat crew. The head covering has a compartment/pouch which can optionally be disguised as to substantially form a hidden pocket. The fabric of the head covering is preferably brightly colored, stylish and decorative, and may be associated with a designer.

U.S. Pat. No. 7,096,510 to Yeadon discloses a head covering commonly known as a skull cap in which the 'tail' extending from the back of the neck is fashioned into a pouch with an elasticized opening. The user styles his/her long hair with a ponytail, applies and secures the skullcap, and then inserts the ponytail hair into the 'tail' pouch. It may be worn under a helmet or hard hat. It has three functions. During windy outdoor activities or while riding in an open vehicle such as a motorcycle, boat, ATV, snowmobile, or convertible automobile, it contains the hair protecting it from the elements which soil the hair and from movement which tangles the hair. In an industrial environment, it effectively contains the hair to prevent free hair from falling forward and obstructing a worker's vision or entangling in machinery. Thirdly, in medical or food preparation industries, it contains the hair preventing contamination.

U.S. Pat. No. 7,412,729 to McGovern discloses a covering that can be easily removed and installed with the use of tie strips. A piece of elastic insures that the device will fit on all shaped heads.

U.S. Pat. No. 8,032,950 to Leftenant discloses a head covering is described that is positioned on a head of a wearer to retain the wearer's hair in a desired position. The head covering comprises a hooded cap and an extension. The hooded cap includes a pair of ties and a set of straps. The hooded cap is secured to the head of the wearer using ties. The extension connects to the hooded cap on one end and includes an opposing distal end portion with a free terminal end. The extension includes a pouch and a flap. The pouch defines a first aperture in proximity to the hooded cap and a second aperture in proximity to the flap. A passageway is defined between the first aperture, the extension and the second aperture. The flap and pouch include connectors for the optional connection of the flap and pouch to secure the second aperture in a closed position. At least one strap is connected to the extension. The straps are constructed to secure the extension and hair together. The head covering has a first position wherein the head covering is passed along the hair of the wearer from a distal end of the wearer's hair to the wearer's head. The second position of the head covering includes the hooded cap positioned on the wearer's head and the hair of the wearer at least partially positioned in the passageway defined in the extension.

U.S. Pat. No. 9,138,025 to Lunsford discloses a head covering made from a stretchable fabric forming an elongated tubular shaped article. The head covering has a front opening with a band portion to secure the head covering to a head. The head covering securely extends around the head and extends the full length of the hair to a back opening. The head covering is designed to circumferentially surround fully extended hair along the entire length of the hair. The head covering is designed to permit configuration flexibility, allowing it to protect hair, prevent user distraction from blowing hair, and permit for the safe wearing of a head apparatus.

U.S. Pat. No. 9,907,381 to Tussey discloses a hair wrap envelopes the hair. The hair wrap comprises a cap portion, a pouch, and side walls. The cap portion has at least one attachment means. At least two elongated ties located on opposite sides of the side walls are adapted to be twisted for securing the wrap on the user's head. A material loop is located on a back base of the pouch to hold the ties in place. An attachment means located on a bottom edge of the pouch mates with the attachment means of the cap portion. A crown loop located on the top section is adapted to hold the pouch after the pouch is twisted and lifted toward the top section. The pouch is adapted to lay untwisted when the wrap is in an extended position, and to be twisted and lifted upward when the wrap is in a wrapped position.

U.S. Pat. D669,662 to Reid discloses an ornamental design for a head-wrap with pouch for hair, as shown and described.

United States Patent Application 2003/0221243 to Phillips discloses a head covering for covering the hair, particularly long or braided hair is provided. The head covering comprises a cap portion for covering the head, a pouch portion for encasing the hair and means to secure the head covering to the head. The head covering may be made of any suitable fabric material and may contain elastic to provide a snug fit.

United States Patent Application 2005/0034215 to Harrison et al. discloses a head scarf adapted to be worn typically beneath a motorcycle helmet or other headgear includes an apron depending from its rear beneath its headband. A pocket within the apron bolds cooling or warming elements against the wearer's neck to modulate wearer comfort. Thin, baffle-stitched, comfort control packs fit within the pockets, the packs containing water absorption crystals that absorb and thermally treated water without substantial dripping or rapid evaporation. A commercially available warming envelope may be substituted for convenience when appropriate. A triangular tail beneath the pocket helps hold the pocket in place against the neck, and a pony-tail aperture above the pocket prevents a wearer's long hair from interfering with the pocket's juxtaposition on the wearer's neck.

United States Patent Application 2006/0272073 to Marquardt discloses a modified head covering has a cap portion that resembles typical head caps, as well as a pouch portion attached to the rear of the cap. This head covering allows a user having long hair to safely conceal his or her hair within the pouch portion at the rear of the head covering. The pouch portion can be cinched tightly into a "sack" or "pouch" shape through the use of a ribbon, an elastic band, or other devices. Once the pouch portion is constricted, the hair is safely concealed and kept off of the nape of the neck. The head covering can be made of a variety of fabrics with a number of patterns or colors. The modified head covering is particularly suited to medical personnel working in sterile environments, but it is useful for anyone with long hair who must conceal his or her hair inside a cap.

United States Patent Application 2009/0089916 to Lieutenant discloses a head covering consisting of: a hooded portion that sits on top of the wearers head, a back portion containing a pocket/passageway for the hair/braids to pass through, middle and bottom straps positioned on the back portion of the invention to hold the hair/braids in place. The method of application of this invention is as such: the wearer puts their hand through the passageway grabbing their hair and pulling it through the passageway. Then the hooded portion is pulled towards the top of the wearers head and positioned on top of head. Next the straps on the hooded portion are tied behind the wearers head securing the invention in place. Then the middle and bottom straps are snapped beneath the pocketed portion of the invention, between the back of the wearers neck and the invention keeping the hair/braids secure. The invention can be made from many different materials, such as cotton, leather, terry cloth and water resistant fabrics. These are just examples of materials that can be used, and this invention is not limited to these materials. With the many different materials used for this invention, come different uses for the invention. When terry cloth is used to make this invention, it can be used for drying hair. When leather is used it can be used as an extra secure way to hold hair in place while riding a motorcycle. When water resistant material is used with this invention it can be used to prevent hair from getting wet while showering or in rainy weather. These are examples of different uses, but the invention is not limited to theses examples.

United States Patent Application 2009/0126078 to Rashid discloses a multi-piece convertible scarf Δn inner head-scarf and an outer shoulder-scarf that can be styled separately or connectively to provide multiple styles in an all-in-one fashion.

United States Patent Application 2009/0151048 to Laury discloses a hair sleeve includes a cap portion and a sleeve portion integrally formed with the cap portion. The cap portion includes a fastening band and an elastic member for securing the hair sleeve on the head of a person. The fastening band includes separate first and second portions defining a hook and loop fastener for adjusting the hair sleeve on the head of the person. The elastic member extends along only a portion of the periphery of the cap portion and is positioned opposite the fastening band so that an opening is defined between the fastening band and the elastic member. The hair sleeve may be made of a material selected from acetate, rayon, nylon, and silk, and may be formed with a satin weave that defines a matte surface on the exterior of the hair sleeve and a non-abrasive surface of the interior of the hair sleeve.

United States Patent Application 2010/0294301 to Blasingame discloses a hair retaining device for preventing long hair of a wearer of the hair retaining device from getting tangled and damaged. The hair retaining device includes a cap member configured to cover a head portion of the wearer thereof, a pair of straps configured on a rear end portion of the cap member, a tail member extending from the rear end portion of the cap member, and a flap member configured on an inner surface of the tail member. The pair of straps is capable of securing the cap member to the head portion of the wearer thereof. Further, the flap member and the inner surface of the tail member configures a space therebetween for receiving at least a portion of the hair of the wearer thereof.

United States Patent Application 2012/0023642 to Holland discloses a garment for retaining long hair is disclosed and claimed. The garment includes a tubular sleeve formed of a lightweight flexible material. The tubular sleeve includes an open front, an open rear, a body therebetween, and an inside surface. The open front is configured to extend across a wearer's forehead. The body extends from the open front over substantially the entire region of the wearer's head. A pocket is attached to the inside surface of the tubular sleeve and includes an opening The pocket is arranged for retaining long hair such as braids or dreadlocks.

United States Patent Application 2012/0079643 to Clarke discloses a hair cover for protecting a wearer's v-shaped hairdo while sleeping having two fabric chambers, one dome-shaped and the other v-shaped.

United States Patent Application 2015/0209621 to Cason et al. discloses a swim cap for persons having long hair includes a shell preferably having at least two interconnected compartments for receiving and encapsulating the hair of a user. The swim cap is secured around the head of a user by at least one draw string or adjustable band positioned within a channel near the open end of the swim cap as well as a chin strap extending downwardly from the cap. The interconnected compartments can be inflated to provide buoyancy. The shell further includes an outer layer and an inner layer defining a space therebetween that can also be inflated, or comprised of buoyant material, to provide buoyancy. A pump, compressed air canister or manual filler tube in communication with the interconnected compartments or space within the shell can be used to provide inflation. A pair of ear flaps extends downwardly from the swim cap around a user's head.

United States Patent Application 2019/0037944 to Tussey discloses a hair wrap envelopes the hair. The hair wrap comprises a cap portion, a pouch, and side walls. The cap portion has at least one attachment means. At least two elongated ties located on opposite sides of the side walls are adapted to be twisted for securing the wrap on the user's head. A material loop is located on a back base of the pouch to hold the ties in place. An attachment means located on a bottom edge of the pouch mates with the attachment means of the cap portion. A crown material loop located on the top section is adapted to hold the pouch after the pouch is twisted and lifted toward the top section. The pouch is adapted to be worn in a variety of styles, including to lay untwisted when the wrap is in an extended position, and twisted and lifted upward when the wrap is in a wrapped position.

Although the aforementioned prior art have contributed to the development of the art of hair coverings, none of these prior art patents have solved the needs of this art.

Therefore, it is an object of the present invention to provide an improved hair covering.

Another object of this invention is to provide an improved hair covering which protects the hair and the head of an individual.

Another object of this invention is to provide an improved hair covering which may be utilized with an individual with long hair.

Another object of this invention is to provide an improved hair covering which may be utilized with an individual with short hair.

Another object of this invention is to provide an improved hair covering which is easy to secure to the head of the individual.

Another object of this invention is to provide an improved hair covering that is easy to cost effectively produce.

Another object of this invention is to provide an improved hair covering that is disposable.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to an improved head covering for shielding the hair and head of an individual. The head covering comprises a hood defining a front edge, a first side edge, a second side edge and a rear edge for engaging over the hair and the head of the individual. A rear panel is removably coupled to the rear edge of the hood. A pouch is defined within the rear panel for receiving the hair of the individual.

In a more specific embodiment of the invention, a first tether is removably coupled to the first side edge of the hood. A second tether is removably coupled to the second side edge of the hood In one embodiment of the invention, the hood includes an upper rear housing member for receiving the hair of the individual.

In another embodiment of the invention, the hood, the rear panel, the first tether and the second tether are constructed from a disposable material.

In another embodiment of the invention, the head covering comprises a hood defining a front edge, a first side edge, a second side edge and a rear edge for engaging over the hair and the head of the individual. A rear panel is coupled to the rear edge of the hood. A pouch is defined within the rear panel for receiving the hair of the individual. A first tether is coupled to the first side edge of the hood. A second tether is coupled to the second side edge of the hood. The hood, the rear panel, the first tether and the second tether are constructed from a disposable material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
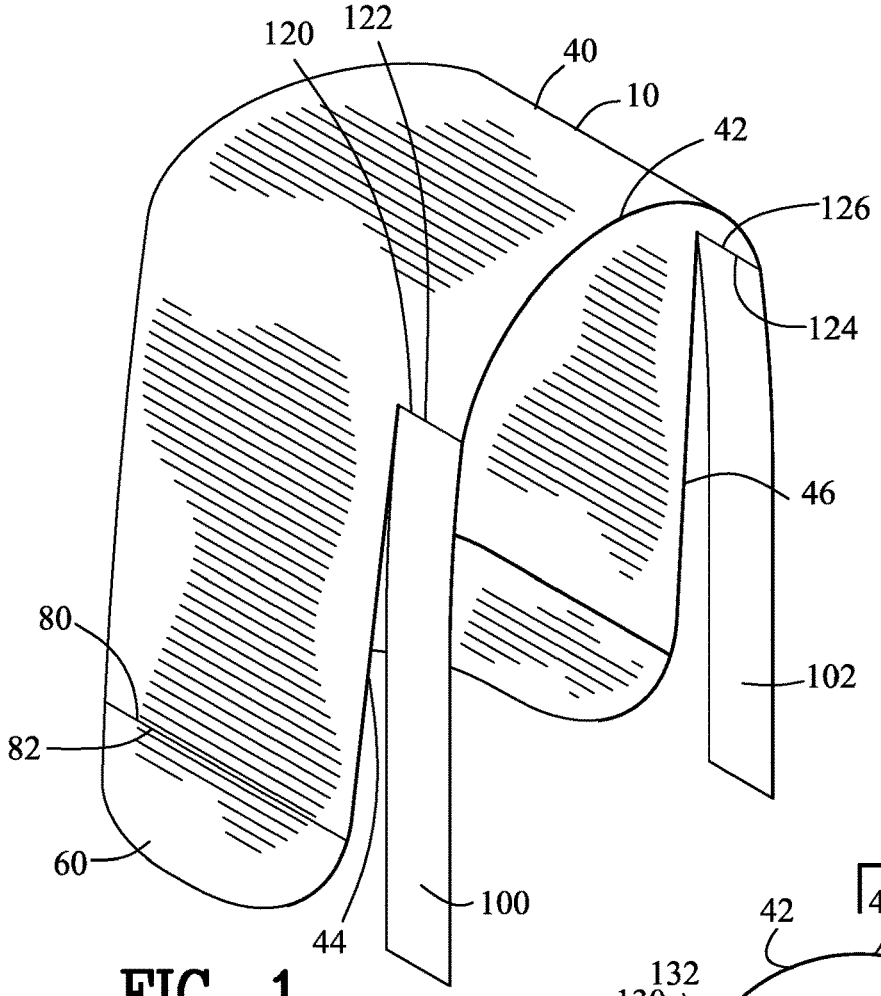
FIG. 1 is a front isometric view of a head covering incorporating the present invention.
Figure 2:
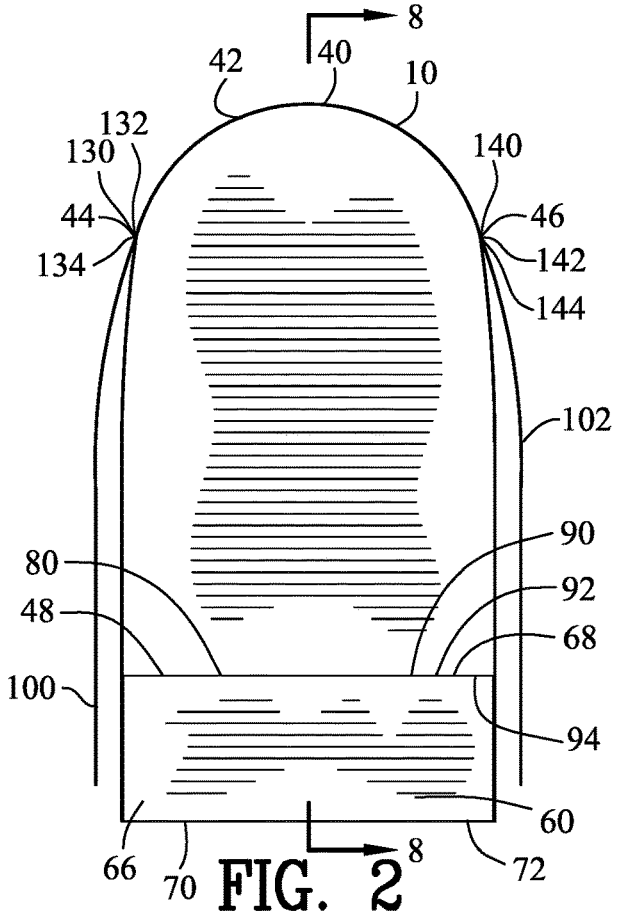
FIG. 2 is a front view of FIG. 1.
Figure 3:
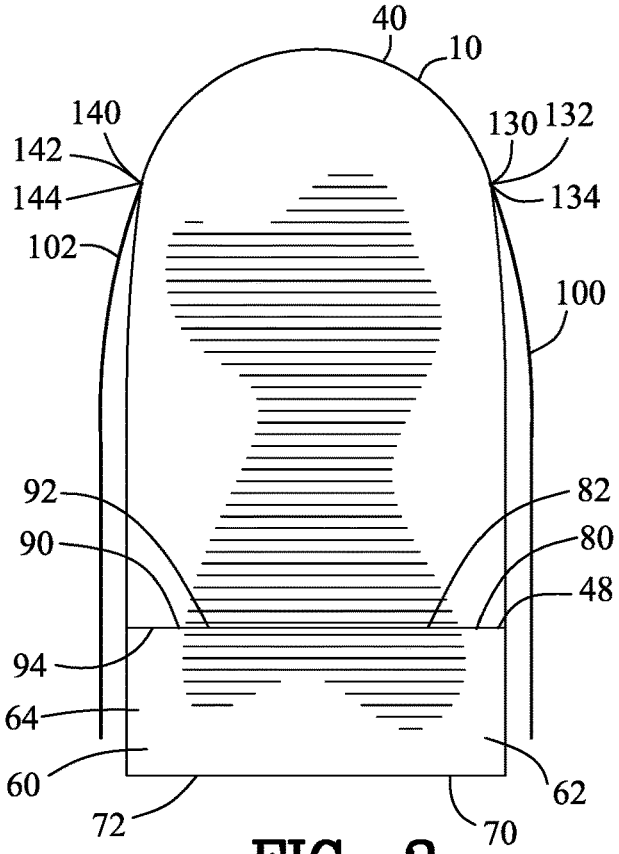
FIG. 3 is a rear view of FIG. 1.
Figure 4:
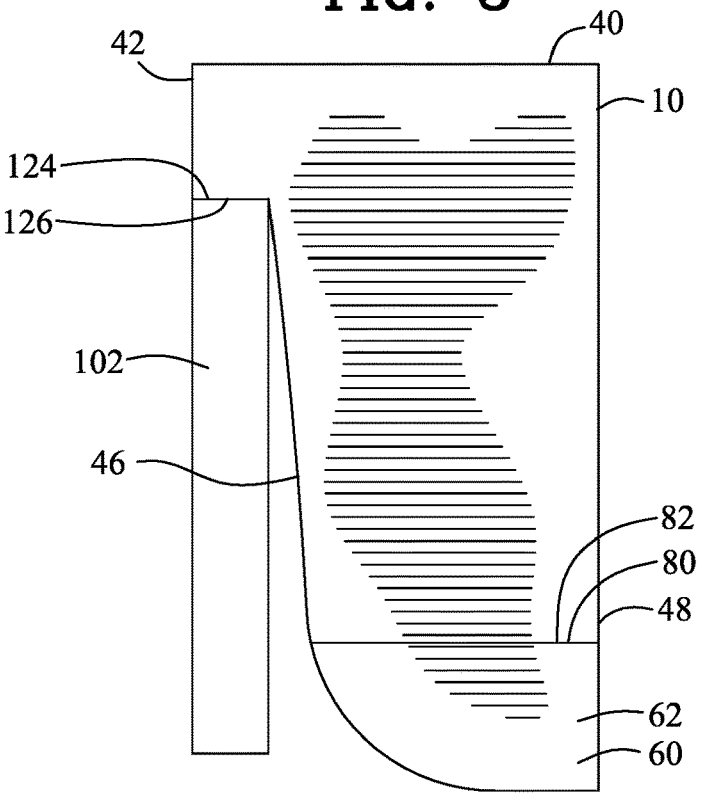
FIG. 4 is a right side view of FIG. 1.
Figure 5:
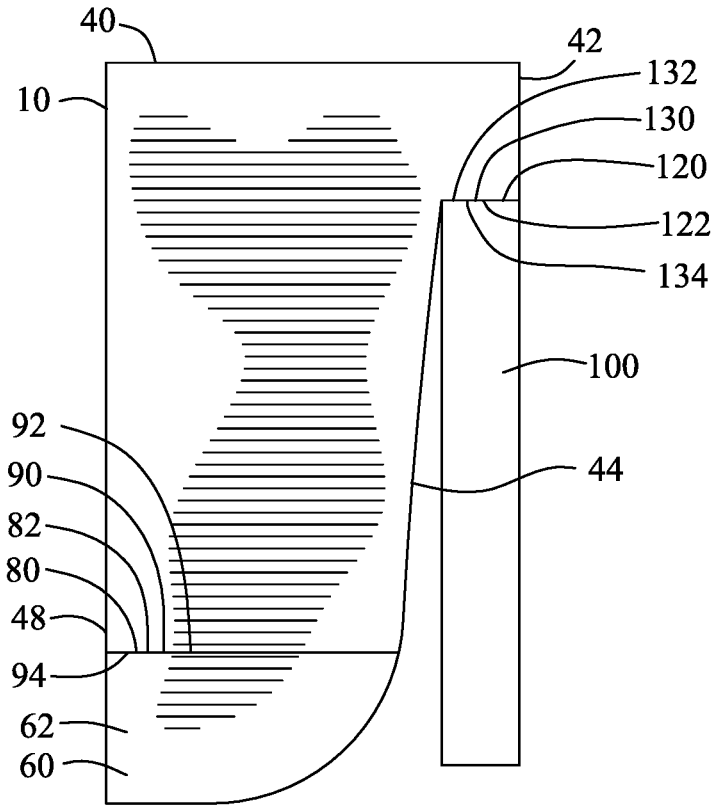
FIG. 5 is a left side view of FIG. 1.
Figure 6:
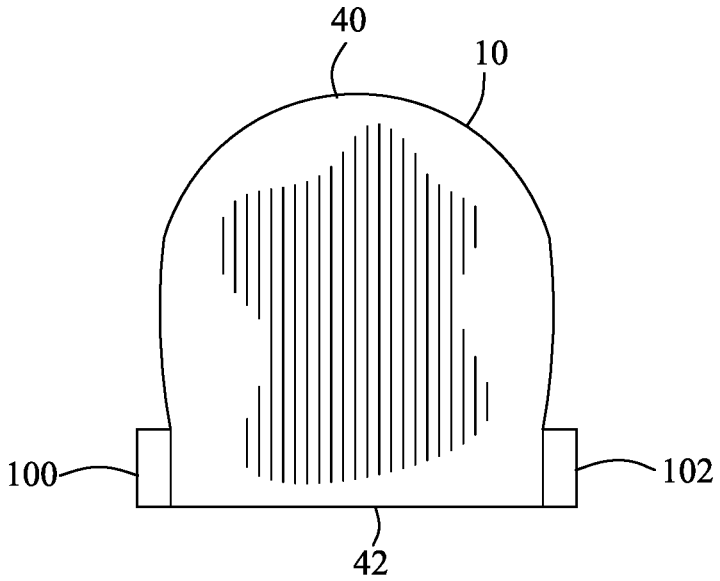
FIG. 6 is a top view of FIG. 1.
Figure 7:
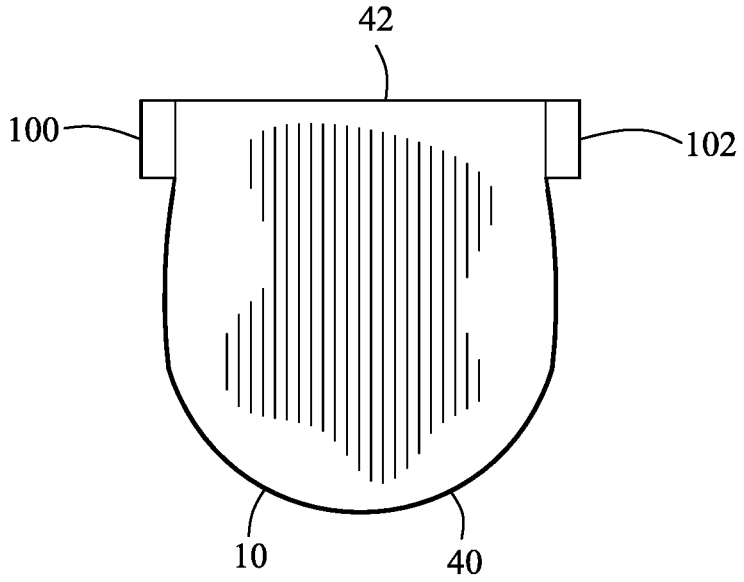
FIG. 7 is a bottom view of FIG. 1.
Figure 8:
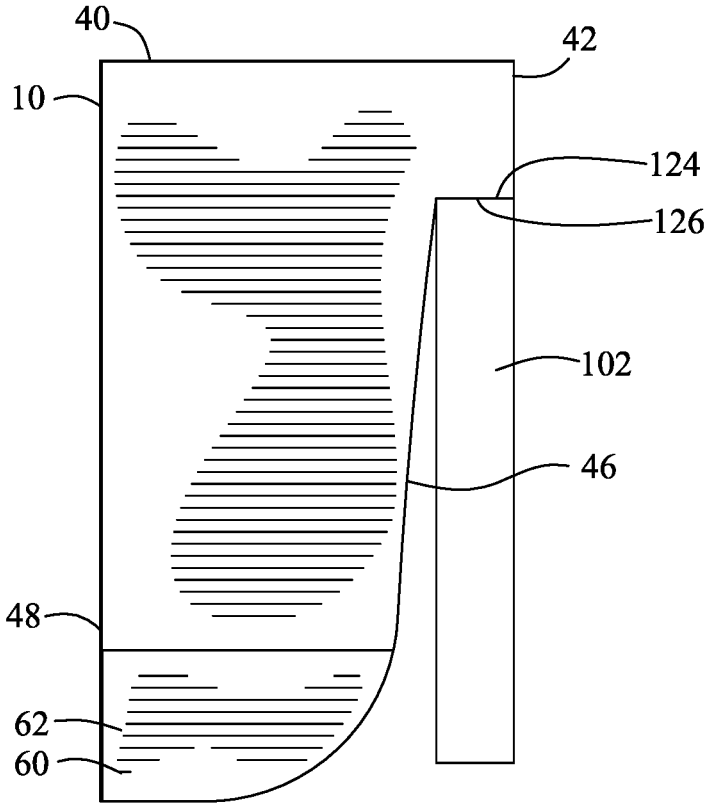
FIG. 8 is a sectional view along line 8-8 in FIG. 2.
Figure 9:
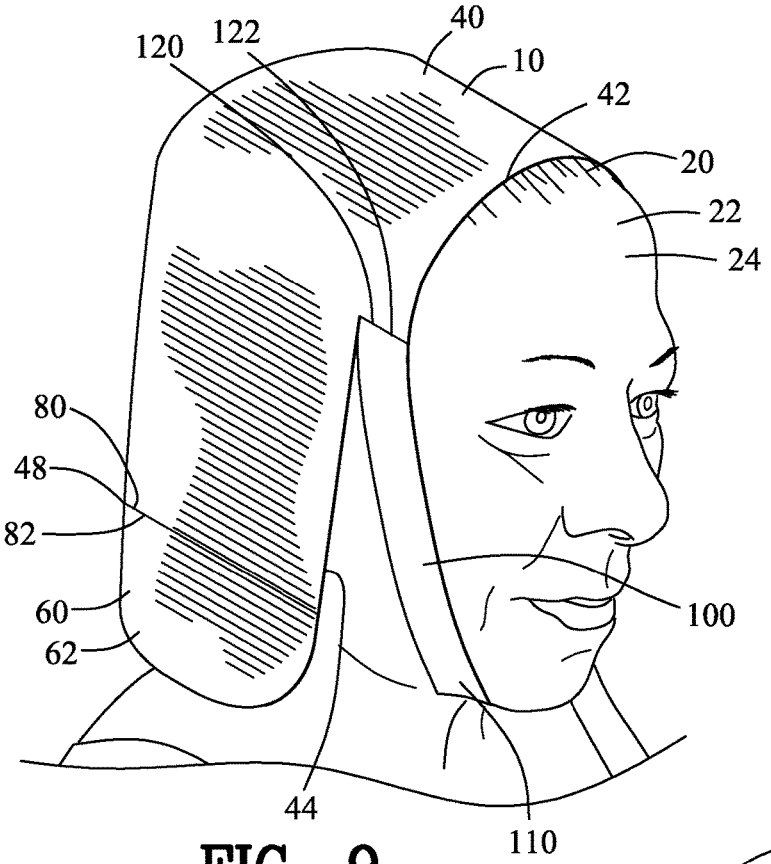
FIG. 9 is a view similar to FIG. 1 illustrating the head covering engaging the head of an individual with a first tether and a second tether forming a vertical U-shape attachment.
Figure 10A:
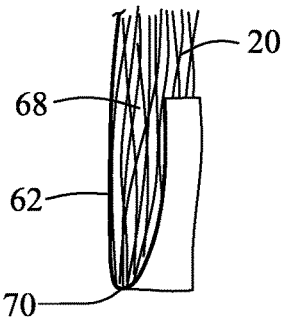
FIG. 10A is a sectional view along line 10A-10A in FIG. 10.
Figure 10:
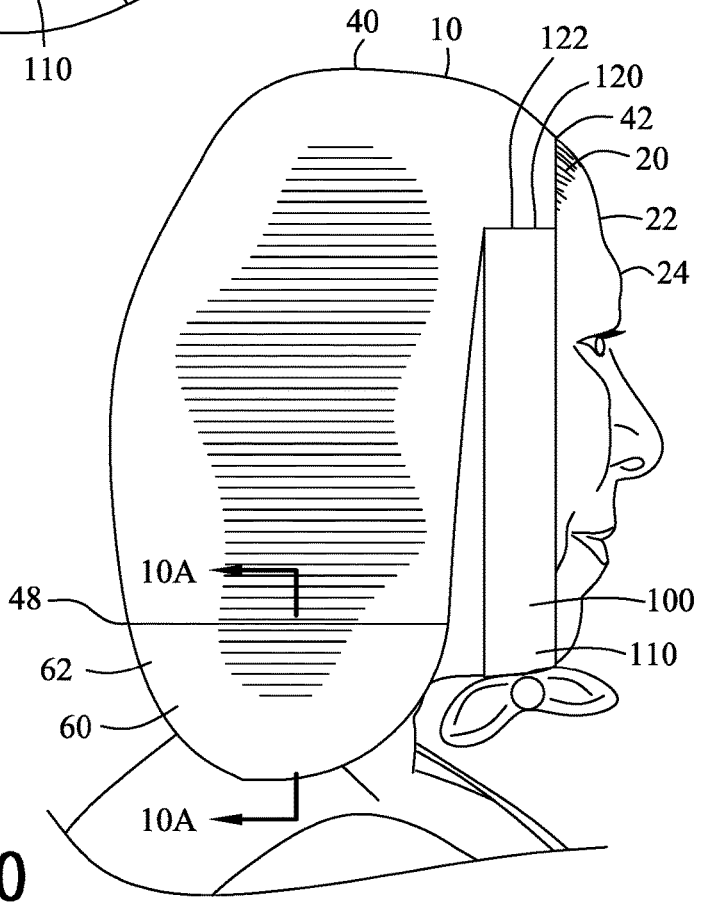
FIG. 10 is a left side view of FIG. 9.
Figure 11:
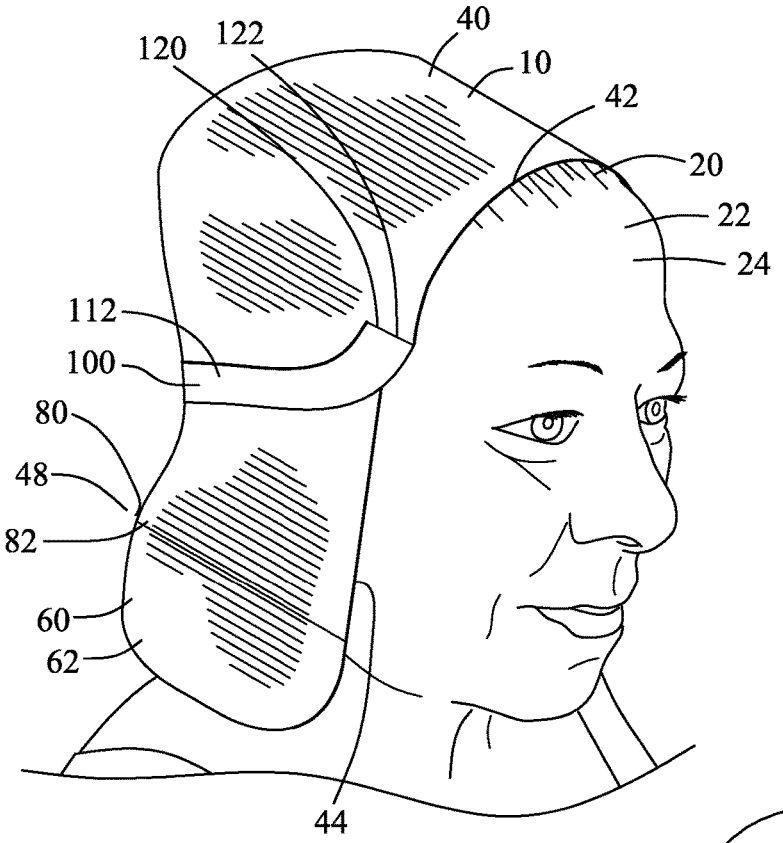
FIG. 11 is a view similar to FIG. 9 illustrating the first tether and the second tether forming a horizontal U-shape attachment.

FIGS. 1-20 are various views of a head covering 10 for shielding the hair 20 and head 22 of an individual 24. The head covering 10 comprises a hood 40 defining a front edge 42, a first side edge 44, a second side edge 46 and a rear edge 48 for engaging over the hair 20 and the head 22 of the individual 24. The hood 40 may be positioned over the hair 20 and the head 22 for protecting the hair 20 and the head 22 from elements such as rain, sleet, snow, ultraviolet radiation, and wind. Specifically, the hood 40 may be utilized after an individual has completed a hair service such as cutting, treating and conditioning for preserving the hair 20.

A rear panel 60 may be removably coupled to the rear edge 48 of the hood 40. A pouch 62 is defined within the rear panel 60 for receiving the hair 20 of the individual 24. The pouch 62 may be constructed from an exterior panel 64 adjacent an interior panel 66. The exterior panel 64 and the interior panel 66 define a pouch aperture 68. An individual 24 which has longer hair 20 may position the hair 20 through the pouch aperture 68 and between the exterior panel 64 and the interior panel 66 for protecting the hair 20 within the pouch 62. Preferably, the pouch 62 includes a sealed lower edge 70 for maintaining the hair 20 within the pouch 62. However, the pouch 62 may include a lower pouch aperture 72 that permits the hair 22 traverse the pouch 62. The hood 40 in combination with the pouch 62 will protect the hair 20 from any elements such as rain, sleet, snow, ultraviolet radiation, and wind. Specifically, the hood 40 and pouch 62 may be utilized after an individual has completed a hair service such as cutting, treating and conditioning for preserving the hair 20.

Figure 15:
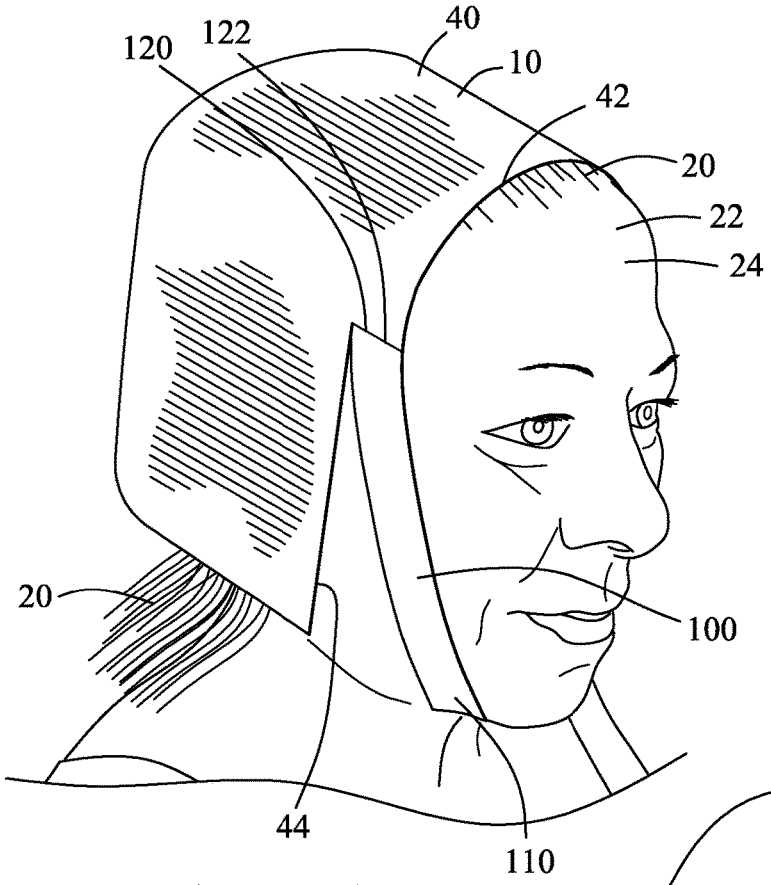
FIG. 15 is a view similar to FIG. 9 illustrating a rear panel removed from the hood.
Figure 16:
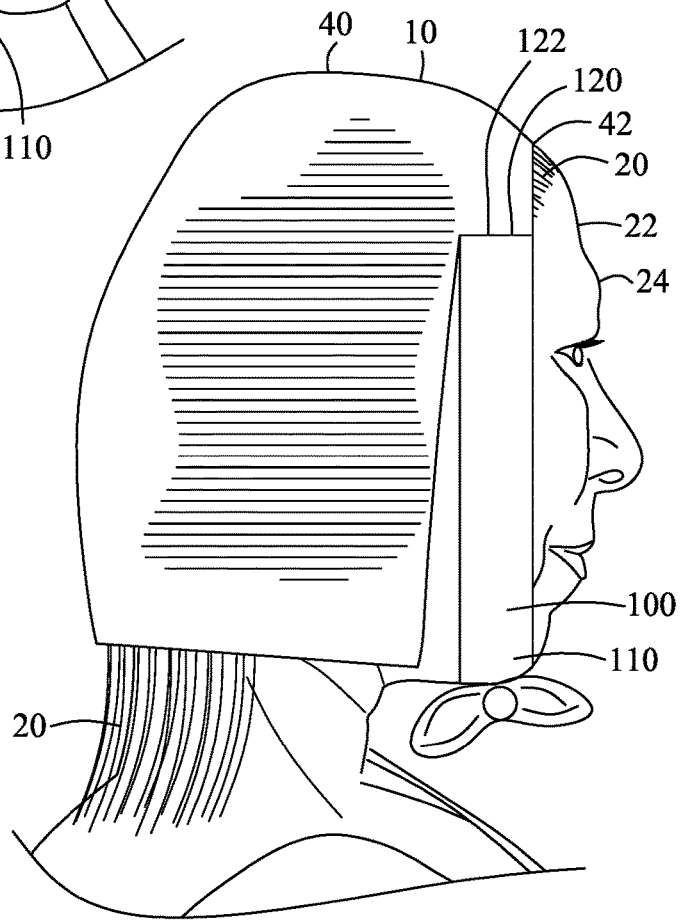
FIG. 16 is a left side view of FIG. 15.

The rear panel 60 may be removably coupled to the rear edge 48 of the hood 40 by a rear perforation 80 between the hood 40 and the rear panel 60. The rear perforation 80 permits the rear panel 60 to be torn away from the hood 40. More specifically, the rear perforation 80 may include a plurality of apertures 82 having a linear or nonlinear alignment. Preferably, the hair covering 10 would be produced by including both the hood 40 and the rear panel 60. As shown in FIGS. 15 and 16, if after a hair service, the rear panel 60 was not needed or interfered with the hair 20 or other item, the rear panel 60 may be elected for separation with the hood 40.

Alternatively, the rear panel 60 may be removably coupled to the rear edge 48 of the hood 40 by a rear interlocking groove and ridge coupling 90. The rear interlocking groove and ridge coupling 90 disengages for permitting the rear panel 60 to be removed from the hood 40. More specifically, the rear interlocking groove and ridge coupling 90 may include an interlocking groove 92 coupled to rear edge 48 and an interlocking ridge 94 coupled to the rear panel 60. Preferably, the hair covering 10 would be produced by including both the hood 40 and the rear panel 60. As shown in FIGS. 15 and 16, if after a hair service, the rear panel 60 was not needed or interfered with the hair 20 or other item, the rear panel 60 may be elected for separation with the hood 40.

The hair covering 10 may further include a first tether 100 is removably coupled to the first side edge 44 of the hood 40. A second tether 102 may be removably coupled to the second side edge 46 of the hood 40. As best shown in FIGS. 9, 10, 15 and 16, the first tether 100 and the second tether 102 may be coupled below the head 22 of the individual 24 for defining a vertical U-shape attachment 110 and retaining the hood 40 relative to the hair 20 and head of the individual 24. Preferably, the first tether 100 and the second tether 102 may be tied together under the head 22 of the individual 24.

Figure 12:
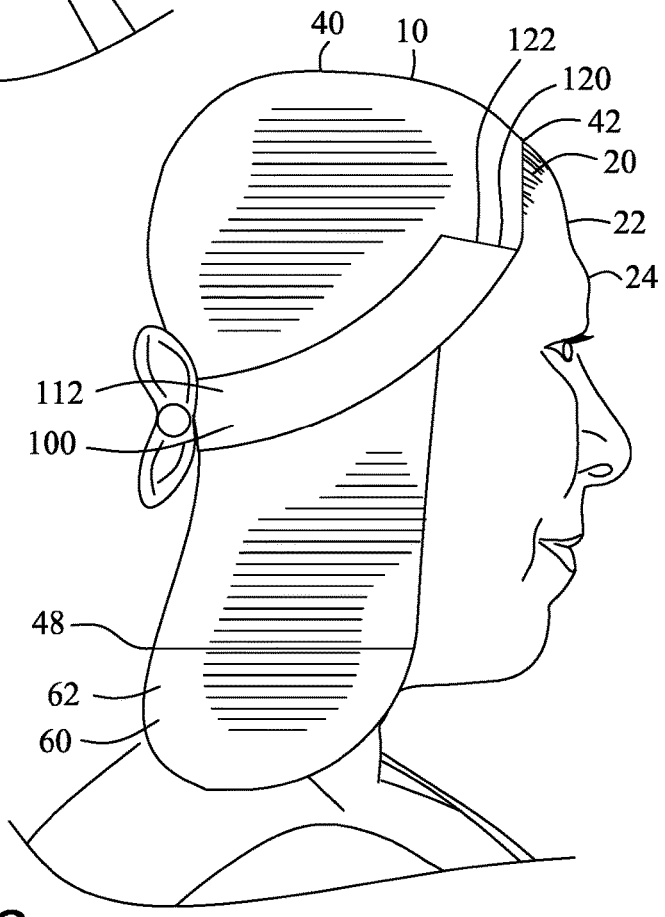
FIG. 12 is a left side view of FIG. 11.
Figure 13:
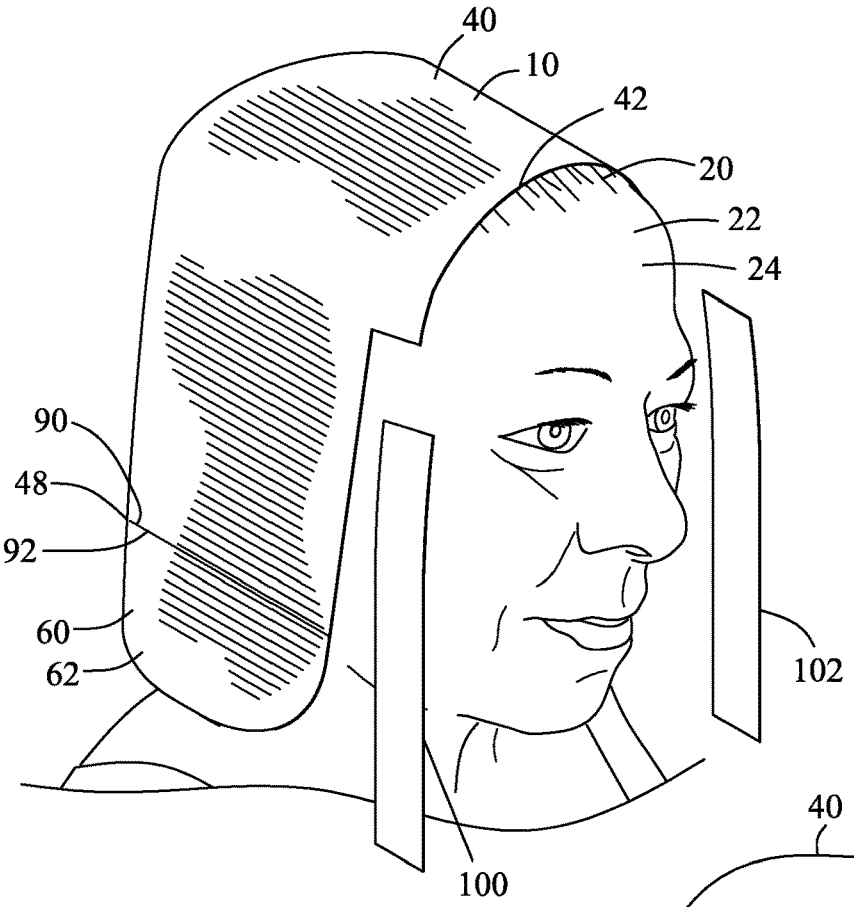
FIG. 13 is a view similar to FIG. 9 illustrating the first tether and the second tether removed from the hood.
Figure 17:
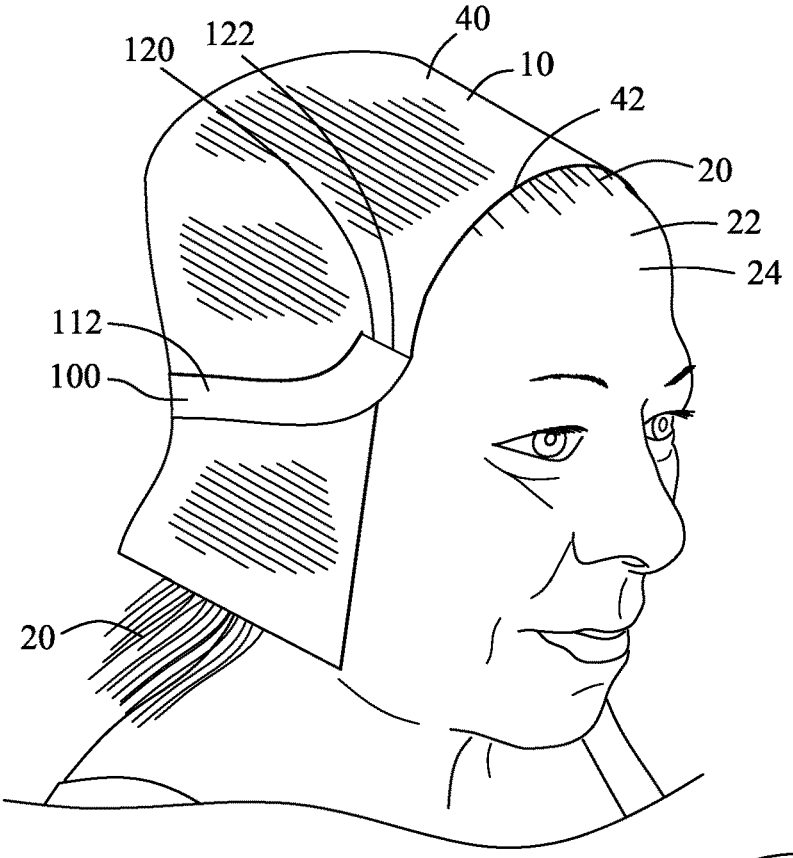
FIG. 17 is a view similar to FIG. 11 illustrating the rear panel removed from the hood.
Figure 18:
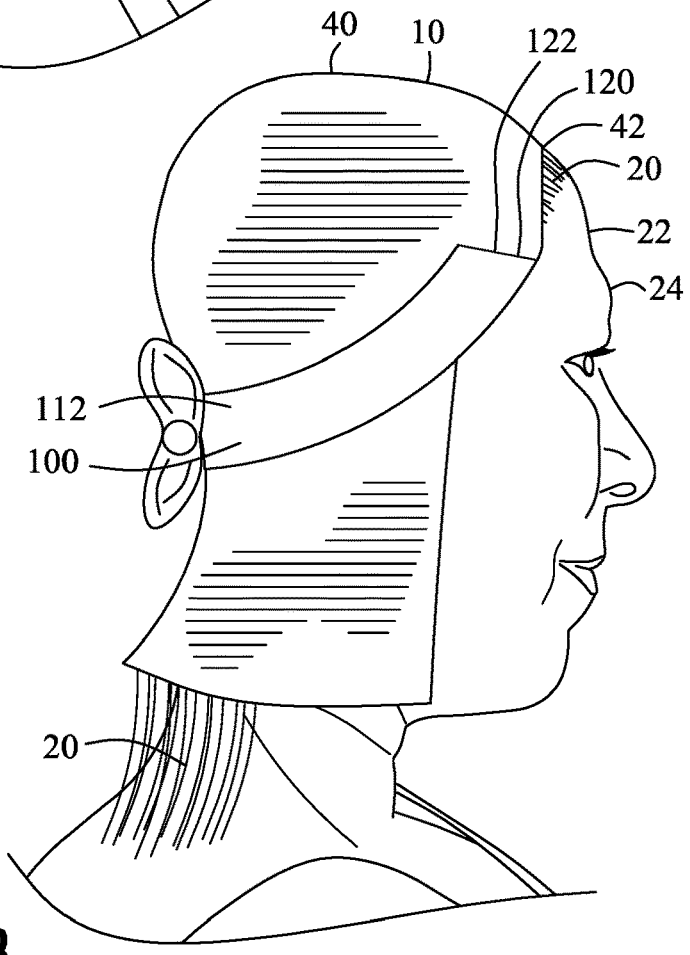
FIG. 18 is a left side view of FIG. 17.

Alternatively, as best shown in FIGS. 12, 17 and 18, the first tether 100 and the second tether 102 may be coupled behind the head 22 of the individual 24 for defining a horizontal U-shape attachment 112 and retaining the hood 40 relative to the hair 20 and head 22 of the individual 24. Preferably, the first tether 100 and the second tether 102 may be tied together behind the head 22 of the individual 24.

The first tether 100 may be removably coupled to the first side edge 44 of the hood 40 by a first perforation 120 between the hood 40 and the first tether 100. The first perforation 120 permits the first tether 100 to be torn away from the hood 40. Similarly, the second tether 102 may be removably coupled to the second side edge 46 of the hood 40 by a second perforation 124 between the hood 40 and the second tether 102. The second perforation 124 permits the second tether 102 to be torn away from the hood 40.

Figure 14:
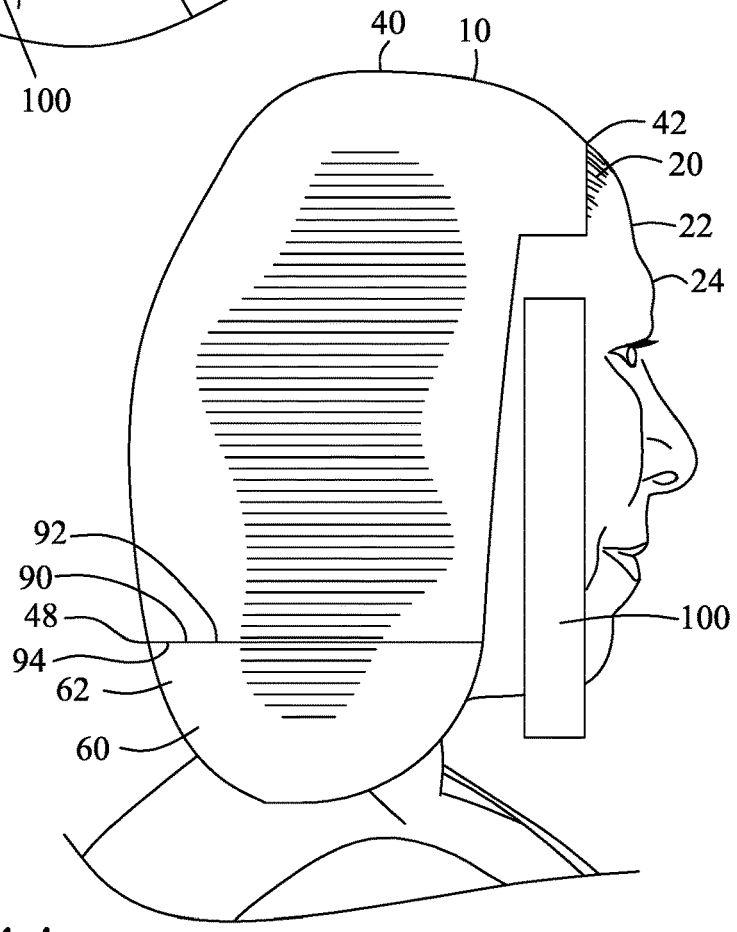
FIG. 14 is a left side view of FIG. 13.

More specifically, the first perforation 120 may include a plurality of apertures 122 having a linear or nonlinear alignment. Preferably, the hair covering 10 would be produced by including both the hood 40 and the first tether 100. If after a hair service, the first tether 100 was not needed or interfered with the hair 20 or other item, the first tether 100 may be elected for separation with the hood 40. Similarly, the second perforation 124 may include a plurality of apertures 126 having a linear or nonlinear alignment. Preferably, the hair covering 10 would be produced by including both the hood 40 and the second perforation 124. As shown in FIG. 14, if after a hair service, the second tether 102 was not needed or interfered with the hair 20 or other item, the second tether 102 may be elected for separation with the hood 40.

Alternatively, the first tether 100 may be removably coupled to the first side edge 44 of the hood 40 by a first interlocking groove and ridge coupling 130 between the hood 40 and the first tether 100. The first interlocking groove and ridge coupling 130 disengage for permitting the first tether 100 to be removed from the hood 40. More specifically, the first interlocking groove and ridge coupling 130 may include a first interlocking groove 132 coupled to first side edge 44 and a first interlocking ridge 134 coupled to the first tether 100. Preferably, the hair covering 10 would be produced by including both the hood 40 and the first tether 100. As shown in FIG. 14, if after a hair service, the first tether 100 was not needed or interfered with the hair 20 or other item, the first tether 100 may be elected for separation with the hood 40.

Similarly, the second tether 102 may be removably coupled to the second side edge 46 of the hood 40 by a second interlocking groove and ridge coupling 140 between the hood 40 and the second tether 102. The second interlocking groove and ridge coupling 140 disengage for permitting the second tether 102 to be removed from the hood 40. More specifically, the second interlocking groove and ridge coupling 140 may include a second interlocking groove 142 coupled to second side edge 46 and a second interlocking ridge 144 coupled to the second tether 102. Preferably, the hair covering 10 would be produced by including both the hood 40 and the second tether 102. As shown in FIG. 14, if after a hair service, the second tether 102 was not needed or interfered with the hair 20 or other item, the second tether 102 may be elected for separation with the hood 40.

Figure 19:
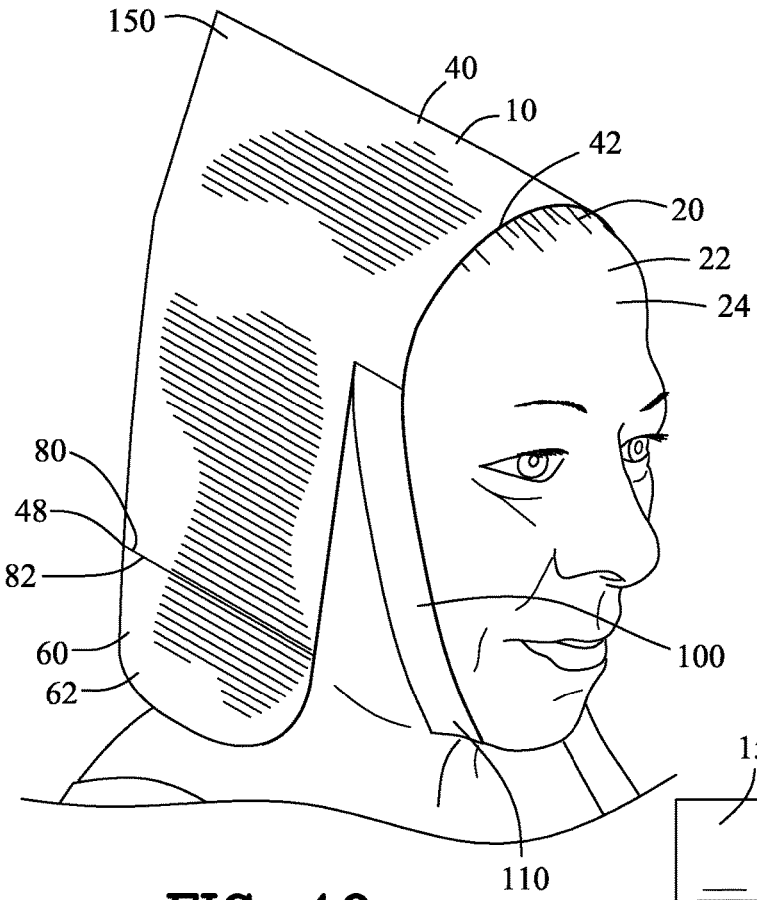
FIG. 19 is a view similar to FIG. 9 illustrating the hood including an upper rear housing member.
Figure 20:
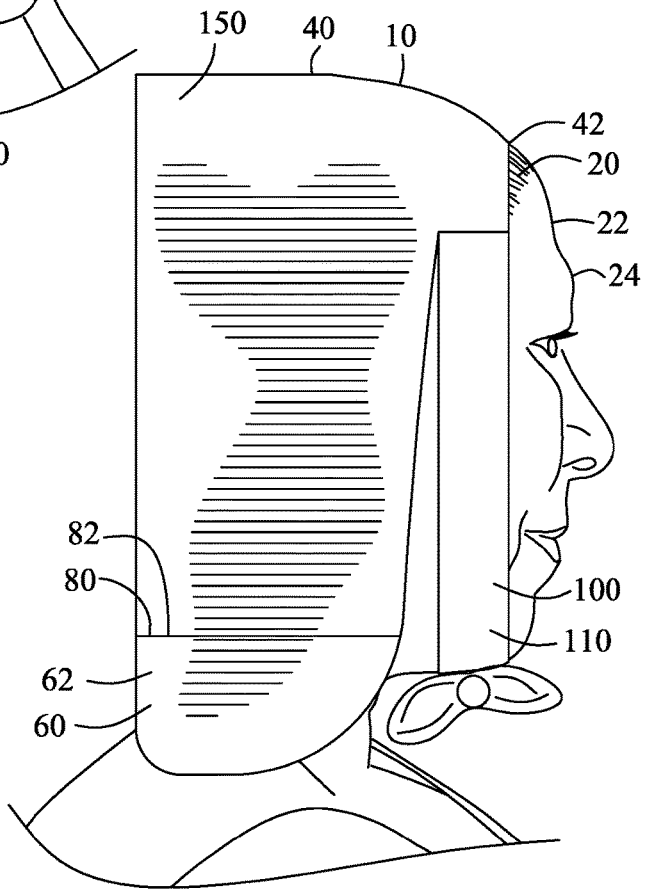
FIG. 20 is a left side view of FIG. 19.

As best shown in FIGS. 19 and 20, the hood 40 may include an upper rear housing member 150 for receiving the hair 20 of the individual 24. The upper rear housing member 150 provides an increased area of the hood 40. The upper rear housing member 150 may be beneficial if the hair 20 is positioned in an upper and rear orientation. The increased area provided by the upper rear housing member 150 permits the hood 40 to cover hairstyles in which are elevated and to the rear of the head 22 of the individual 24.

The hood 40, the rear panel 60, the first tether 100 and the second tether 102 may be constructed from a disposable material. In addition, the hood 40, the rear panel 60, the first tether 100 and the second tether 102 may be constructed from an integral one piece unit. For example, the hood 40, the rear panel 60, the first tether 100 and the second tether 102 may be constructed from or cut out from a plastic trash bag.

Similarly, the hood 40 and the upper rear housing member 150 may be constructed from a disposable material. In addition, the hood 40 and the upper rear housing member 150 may be constructed from an integral one piece unit. For example, the hood 40 and the upper rear housing member 150 may be constructed from or cut out from a plastic trash bag. The upper rear housing member 150 may be constructed from the lower corner of a disposable trash bag.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A head covering for shielding hair and a head of an individual, comprising:

a hood for engaging over the hair and the head of the individual, the hood defining a front edge, a first side edge, a second side edge and a rear edge;

a rear panel removably coupled to said rear edge of said hood;

a pouch, defined within said rear panel, for receiving the hair of the individual;

a first tether removable coupled to said first side edge of said hood;

a second tether removable coupled to said second side edge of said hood;

said first tether is removably coupled to said first side edge of said hood by a first perforation between said hood and said first tether;

said first perforation permitting the first tether to be tom away from said hood;

said second tether is removably coupled to said second side edge of said hood by a second perforation between said hood and said second tether; and said second perforation permitting the second tether to be tom away from said hood.

2. The head covering as set forth in claim 1, wherein said rear panel is removably coupled to said rear edge of said hood by a rear perforation between said hood and said rear panel; and said rear perforation permitting the rear panel to be torn away from said hood.

3. The head covering as set forth in claim 1, wherein said rear panel is removably coupled to said rear edge of said hood by a rear interlocking groove and ridge coupling; and said rear interlocking groove and ridge coupling is disengageable for permitting the rear panel to be removed from said hood.

4. The head covering as set forth in claim 1, wherein said first tether and said second tether are configured to be coupled below the head of the individual for defining a vertical U-shape attachment and retaining said hood relative to the hair and head of the individual.

5. The head covering as set forth in claim 1, wherein said first tether and said second tether are configured to be coupled behind the head of the individual for defining a horizontal U-shape attachment and retaining said hood relative to the hair and head of the individual.

6. The head covering as set forth in claim 1, wherein said hood includes an upper rear housing member for receiving the hair of the individual.

7. The head covering as set forth in claim 6, wherein said hood and said upper rear housing member are constructed from a disposable material.

8. The head covering as set forth in claim 1, wherein said hood and said rear panel are constructed from a disposable material.

9. The head covering as set forth in claim 1, wherein said hood, said rear panel, said first tether and said second tether are constructed from a disposable material.

10. A head covering for shielding hair and head of an individual, comprising:

a hood for engaging over the hair and the head of the individual, the hood defining a front edge, a first side edge, a second side edge and a rear edge;

a rear panel removably coupled to said rear edge of said hood;

a pouch, defined within said rear panel, for receiving the hair of the individual;

said rear panel is removably coupled to said rear edge of said hood by a rear perforation between said hood and said rear panel;

said rear perforation permitting the rear panel to be torn away from said hood;

a first tether removably coupled to said first side edge of said hood;

a second tether removably coupled to said second side edge of said hood;

said first tether is removably coupled to said first side edge of said hood by a first perforation between said hood and said first tether;

said first perforation permitting the first tether to be torn away from said hood;

said second tether is removably coupled to said second side edge of said hood by a second perforation between said hood and said second tether; and said second perforation permitting the second tether to be torn away from said hood.

* * * * *